United States Patent [19]

Smolka

[11] 4,143,698

[45] Mar. 13, 1979

[54] PORTABLE WALL PARTITION

[76] Inventor: Kurt Smolka, Nimrodstrasse 20, D-1000 Berlin 28, Fed. Rep. of Germany

[21] Appl. No.: 894,800

[22] Filed: Apr. 10, 1978

[30] Foreign Application Priority Data

Apr. 14, 1977 [DE] Fed. Rep. of Germany ..... 2716736

[51] Int. Cl.[2] ..... E06B 9/08

[52] U.S. Cl. ..... 160/120; 160/135

[58] Field of Search ..... 160/24, 120, 135, 350, 160/351; 98/50; 52/238, 241, 632

[56] References Cited

U.S. PATENT DOCUMENTS

| | | | |
|---|---|---|---|
| 597,788 | 1/1898 | Shaff | 160/350 |
| 668,748 | 2/1901 | Buchanan | 160/135 |
| 1,377,461 | 5/1921 | Brixey | 160/120 |
| 1,398,909 | 11/1921 | North | 160/351 |
| 2,139,580 | 12/1938 | Draper et al. | 160/120 |
| 2,947,239 | 8/1960 | Burgess | 98/50 |
| 2,962,132 | 11/1960 | Reinhardt | 160/351 |
| 3,674,081 | 7/1972 | List | 160/351 |
| 3,967,420 | 7/1976 | Papsco et al. | 52/241 |
| 4,056,903 | 11/1977 | Guarnere | 160/351 |

*Primary Examiner*—Peter M. Caun

*Attorney, Agent, or Firm*—Allison C. Collard; Thomas M. Galgano

[57] ABSTRACT

A portable and foldable wall partition is provided which includes a plurality of spaced-apart, slidable and heightwise adjustable upstanding vertical supports and a plurality of horizontally-extending lateral supports, each of which is pivotably supported at its ends between a pair of adjacent vertical supports to permit a width adjustment of the wall partition. A filler material is wound on the lateral supports and is unwound therefrom to serve as wall panels for the wall partition. The wall partition has an extremely light weight and high degree of stability. It easily accommodates a wide range of room dimensions while affording a highly effective seal with the floor, ceiling, and walls of the room in which it is installed.

7 Claims, 4 Drawing Figures

PORTABLE WALL PARTITION

The present invention relates to a portable wall partition. More particularly, it relates to such a partition which includes a plurality of upstanding, vertically disposed supports and a plurality of associated horizontal supports which are mounted on the upper ends of the upstanding supports for mounting filler material, or the like.

German Pat. No. 852,142 discloses supports which are known as "Nurnberg scissors". However, these wall partitions do not permit sealing engagement with respect to the ceiling of a room. It is also known to longitudinally adjust the supports (German Pat. No. 1,033,880), whereby it is impossible to make the required adjustment in rooms which have different heights.

It is, therefore, an object of the invention to provide a wall partition of the aforementioned type which has a light structure, can be simply installed, and has a high stability, as well as a perfect seal.

This object of the invention is accomplished by the provision of a portable and foldable wall partition which includes a plurality of upstanding, spaced-apart vertical supports, each of which has at least one roller coupled to the lower end thereof to permit rolling of the supports along a floor, and a plurality of sheaths each of which encompasses the lower end portions of one of the vertical supports and which is axially adjustable relative to the vertical support on which it is mounted; the sheaths also include a generally, bell-shaped jacket which encloses the roller and which is engageable with the floor. A plurality of horizontally-extending lateral supports is also provided, each of which extends between a pair of adjacent vertical supports. The lateral supports are supported at their ends on the vertical supports for limited pivotable movement about a vertical axis so as to maintain a minimum angle which is greater than zero between two adjacent lateral supports and to ensure the stability of the wall partition; the lateral supports are also rotatable about their longitudinal axes and are arrestable in a fixed position. A filler material is provided which is at least partially woundable on the lateral supports. The lower end of the filler material serves as a seal for sealing engagement with the floor. The wall partition also includes a plurality of top sealing members, each of which is coupled to one of the lateral supports for sealing the wall partition against a ceiling, and a plurality of flexible joint covering bars for sealing the space between the outermost vertical supports and the adjacent room walls.

The inventive wall partition has a light weight and a very high degree of stability. The wall partition is adjustable to accommodate different room dimensions with inexpensive means which permit an economical making of the wall. Thereby, a perfect sealing is obtained taking in consideration the various sound attenuation characteristics. Due to the folded shape of the mounted wall partition, the stability is increased as well as an improvement of the sound attenuation. The handling during installation and dismantling of the wall partition is simplified, since the wall partition can be moved without any additional transport means, in contrast to other known wall partitions.

Other objects and features of the present invention will become apparent from the following detailed description when taken in connection with the accompanying drawings which discloses several embodiments of the invention. It is to be understood that the drawings are designed for the purpose of illustration only and are not intended as a definition of the limits and scope of the invention disclosed.

In the drawings, wherein similar reference numerals denote similar elements throughout the several views.

Figure 2:
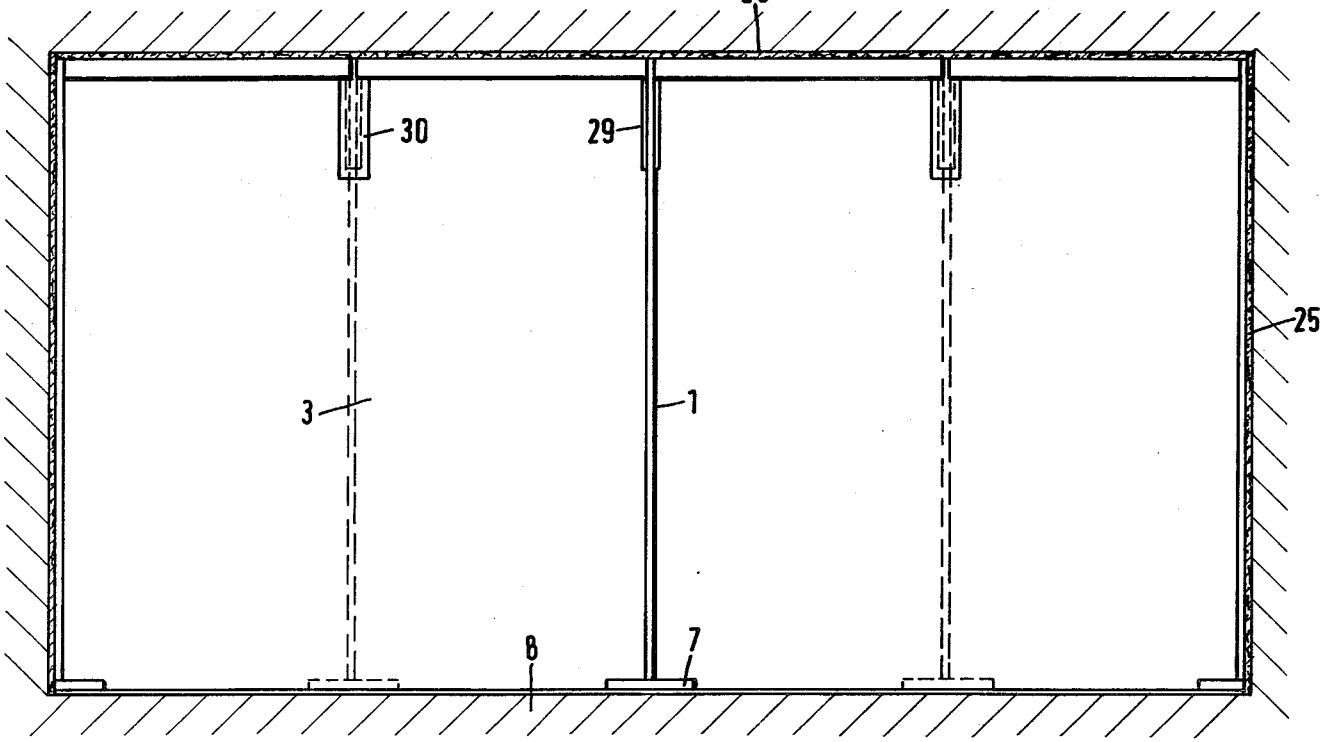
FIG. 2 is a side elevational view of the wall partition shown in FIG. 1.
Figure 1:
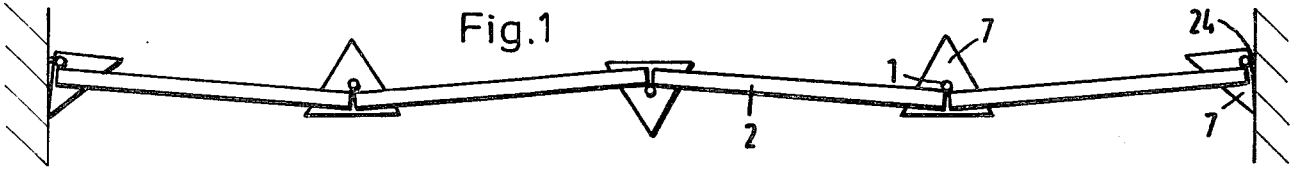
FIG. 1 is a plan view of an installed wall partition embodying the present invention.

Turning now in detail to the drawings, the wall partition shown in FIGS. 1 and 2 consist of five upstanding, vertically-disposed supports 1 having horizontally-extending lateral supports 2 disposed therebetween onto which a filler material 3 is wound which may consist of cloth etc. The wall partition is dimensionally adjustable to accommodate the particular dimensions of the room it is going to be used in. The adjustment in width is accomplished by changing the angle between adjacent lateral supports 2, which are disposed at a slight angle with respect to one another to ensure stability of the partition.

For a heightwise adjustment, cloth 3 is first wound onto supports 2 aned can then be wound off as required. The length of supports 1 is also adjustable.

Figure 3:
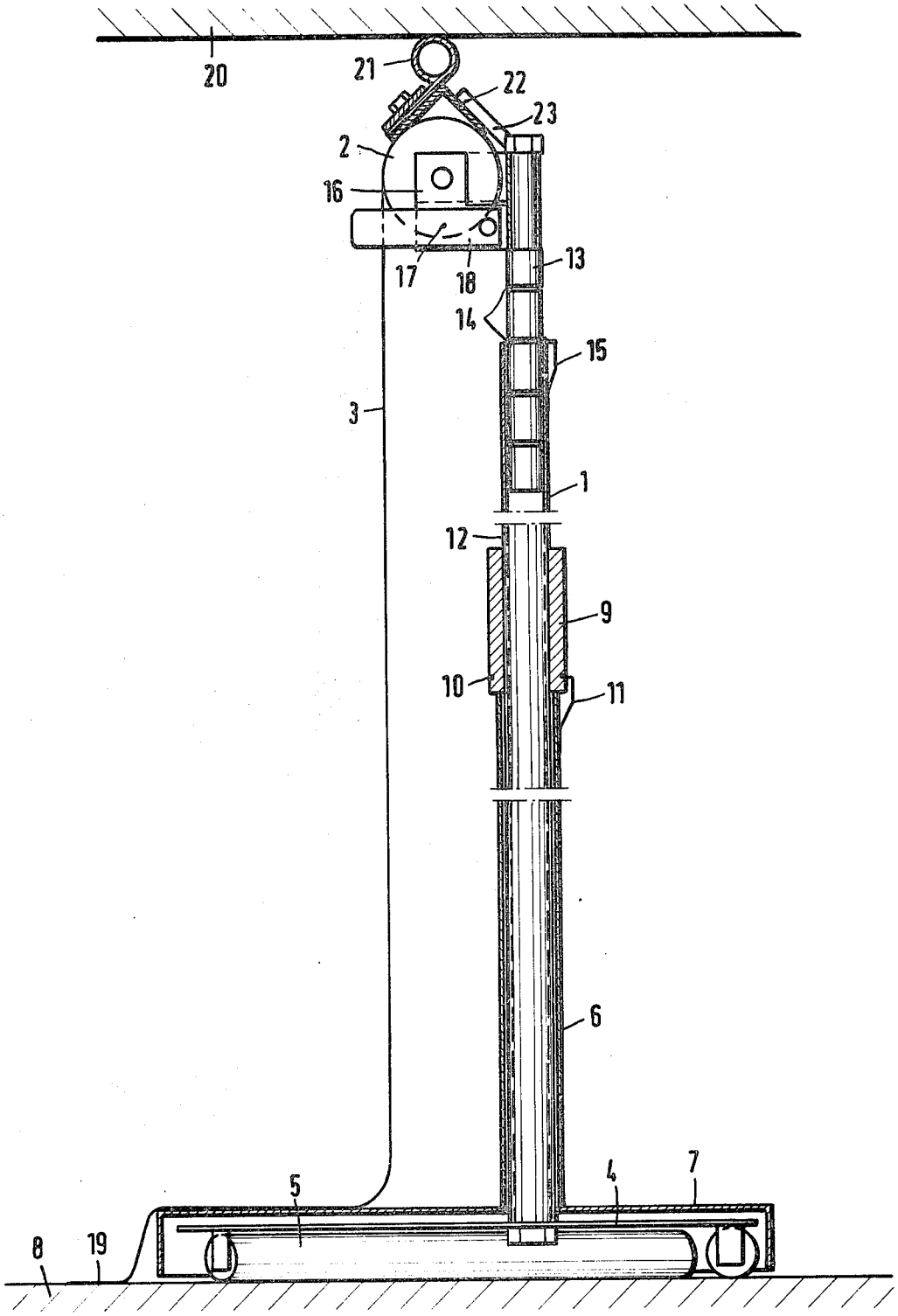
FIG. 3 is a fragmentarilly-illustrated vertical sectional side view, through the axis of a vertical support of the wall partition.

FIG. 3 shows in more detail the structure of support 1 together with a lateral support 2. Support 1 is a pipe which carries on its lower end a chassis 4 having the form of an equilateral triangle on which three cylindrical rollers 5 are mounted, the axes of which are parallel to the sides of the triangle. Essentially, the pipe is mounted in the center of the triangle. The lower part of the pipe is encompassed by a sheath 6 which has a bell-shaped base or jacket 7 which encompasses chassis 4. In the shown position, the support rests on the floor 8 by means of rollers 5, while the bell-shaped jacket 7 is disposed at a certain distance therefrom.

A nut 9 is rotatably but axially rigidly coupled with the upper end of sheath 6. For this purpose a latch 11 is mounted on sheath 6 and engages an annular groove 10 of the nut. Nut 9 runs on a thread 12 of support 1 so that the length of the combined support-sheath unit is adjustable.

A freely-rotatable and axially-displaceable mounting member 13 is provided on the upper end of support 1. Mounting member 13 consists of a rod which is provided with a plurality of axially-spaced apart annular grooves 14, so that a latch 15 which is mounted on the upper part of support 1 can selectively engage one of annular grooves 14. The pivot angle of the mounting member 13 is limited, so as to provide the aforementioned minimum angle for assuring stability for the wall partition. This can be effected by end abutments (not shown).

A cantilever arm 16 is mounted on the upper end of mounting member 13 which acts to rotatably receive one end of support 2 which is in the form of a cylinder on which cloth 3 is wound. Therefore, support 2 with the mounting member 13 is pivotable around a vertical axis. The arrangement is such that the wall partition can be folded in accordance with FIG. 1. Support 2 is selectively arrestable in circumferential direction by means of a pin 17 which can be introduced through a catch 18 and into openings (not shown), so that the height of unwound cloth 3 is adjustable. The lower edge 19 of the filler material or cloth 3 acts as a sliding seal which forms a seal with floor 8.

The supports which are adjacent to walls 25 have essentially the same structure but have only one support 2. In order to reduce the distance from the wall 25, chassis 4 and bell-shaped jacket 7 are formed a little bit different. They have the shape of right triangles (FIG. 1), and support 1 is mounted in the area of the apex forming the corner of the right angle.

For sealing the wall partition against ceiling 20 of the room, a head-sealing member 21 is provided which is mounted on an angle bracket 22. Angle bracket 22 is mounted on support 2 and is clamped on mounting member 13 by clamping pieces 23. Each clamping piece 23 is mounted adjacent rod 13 as is shown more clearly in FIG. 4. The head-sealing member 21 may also be rigidly coupled with support 1.

For installing the wall partition, it is first moved on rollers 5 along floor 8 and is then unfolded. Subsequently, a sufficient amount of filler material 3 is unwound from rollers 2, after a coarse adjustment had been made by means of mounting members 13. After attaching and clamping the heat-sealing member 21, the lengths of support 1 is slowly increased by rotating nut 9. In this way, the bell-shaped jacket 7 engages floor 8 and assumes the supporting function in place of rollers 5, while simultaneously, the head-sealing member 21 is moved toward ceiling 20. The separating wall is then firmly clamped between floor 8 and ceiling 20, in this manner Open joints are closed by means of flexible joint bars 24, as shown, for example, in FIG. 1, in conjunction with the wall 25.

The dismantling of the wall partition is carried out in reverse operation. The wall partition can then be folded together and stored in a suitable storage room.

Figure 4:
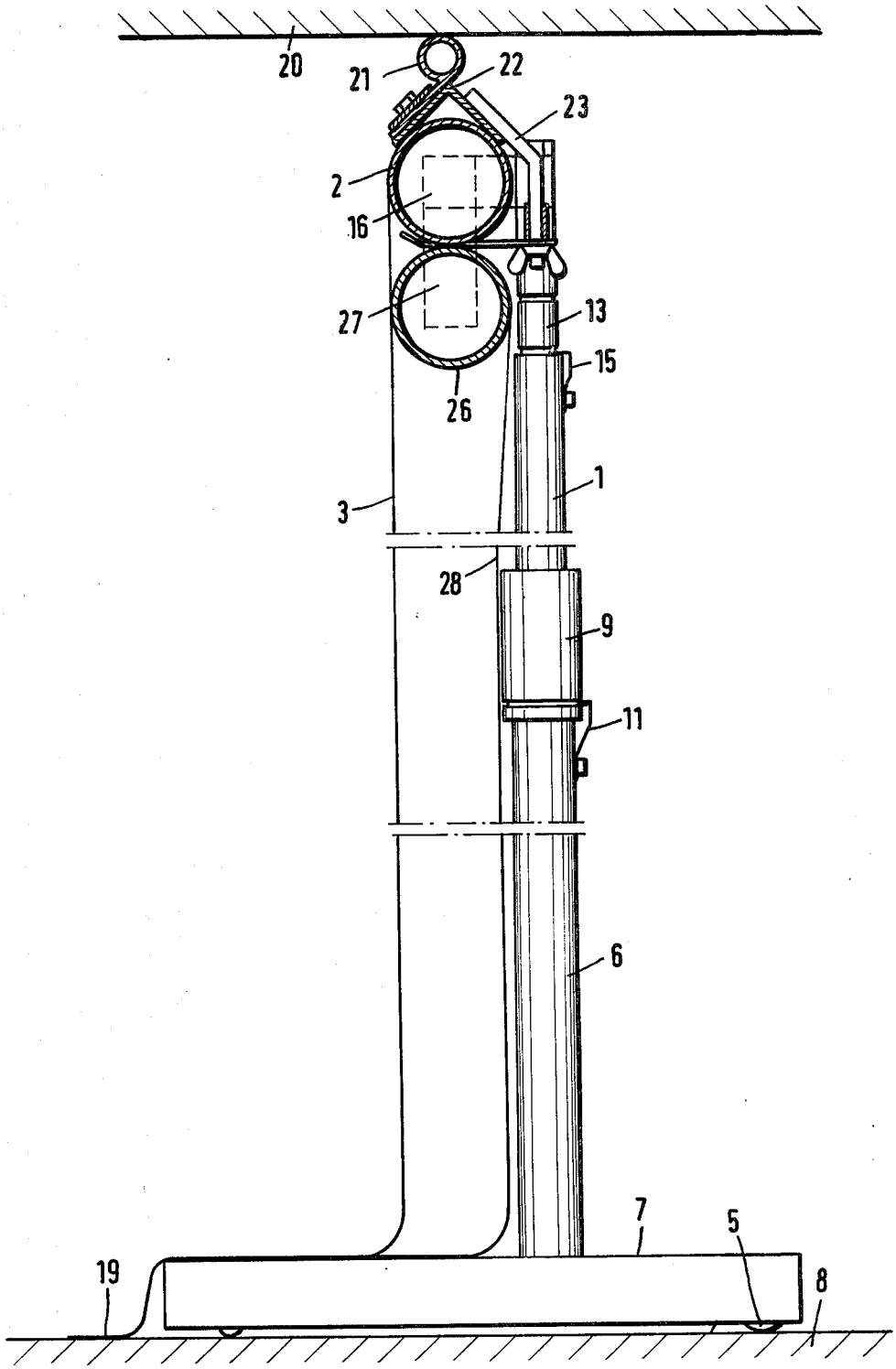
FIG. 4 is a fragmentarilly-illustrated vertical sectional side view taken adjacent the axis of a vertical support which defines an alternate embodiment of the invention.

In accordance with the embodiment of FIG. 4, two filler materials may be provided spaced apart from each other. In this case, the upper end of support 1 is provided with two parallel-arranged supports 2 and 26. The cantilever arm 16 for the upper support 2 has an extension 27 for a rotatable reception of the one end of lower support 26 which is also selectively arrestable in circumferential direction.

The filler material 3 runs off the left side of support 2, while the filler material of support 26 runs off the right side of the support. Hence, a sound and heat attenuation is generated between the two filler materials. The sound attenuation may be even increased by adding additional sound deadening material therebetween. For this purpose, rubber, such as India rubber, may be used as a filler material.

A further embodiment is shown in FIG. 2, wherein a unitary filler material 3, made of cloth or the like, extends over the total width of the wall partition so as to eliminate a plurality of sealing places. The winding of the filler material onto the supports is only required for the difference in room heights. Therefore, the lower area of the filler material can extend over the total width since it never is wound up. However, in the upper ranges, vertically-extending slots 29 are provided adjacent supports 1 so that the upper portions of the filler material which are disposed between the slots can be properly wound onto the corresponding supports 2. The slots may be covered by additional seals 30.

While only a few embodiments of the present invention have been shown and described, it will be obvious to those persons of ordinary skill in the art that many changes and modifications may be made thereunto without departing from the spirit and scope of the invention.

What is claim is:

1. A portable and foldable wall partition, comprising:
   - a plurality of upstanding spaced-apart vertical supports, each of which has at least one roller coupled to the lower end thereof to permit rolling of the supports along a floor;
   - a plurality of sheaths each of which encompass the lower end portion of one of said vertical supports and which is axially adjustable relative to the vertical support on which it is mounted, said sheath including a generally, bell-shaped jacket which encloses said roller and which is engageable with the floor;
   - a plurality of horizontally-extending lateral supports, each of which extends between a pair of adjacent vertical supports, said lateral supports being supported at their ends on said vertical supports for limited pivotable movement about a vertical axis so as to maintain a minimum angle which is greater than zero between two adjacent lateral supports and to ensure the stability of the wall partition, said lateral supports being rotatable about their longitudinal axes and being arrestable in a fixed position;
   - a filler material which is at least partially woundable on said lateral supports, the lower end of which serves as a seal for sealing engagement with the floor;
   - a plurality of top sealing members, each of which is coupled to one of said lateral supports for sealing the wall partition against a ceiling; and
   - a plurality of flexible joint covering bars for sealing the spaced between the two outermost vertical supports and adjacent room walls.

2. The wall partition according to claim 1, wherein said bell-shaped jackets of said sheaths which encompass the vertical supports disposed between the two outermost vertical supports have an equilateral triangular configuration, and said vertical supports extend upwardly from the center of the triangular-shaped jackets and wherein three of said rollers are coupled to each of said vertical supports and are each cylindrically shaped, said rollers coupled to each of said supports being positioned such that their axes are parallel to the sides of the triangular-shaped jacket of said sheaths.

3. The wall partition according to claim 1, wherein said bell-shaped jackets of said sheaths which encompass said outermost vertical supports have a right triangular configuration and said outermost vertical supports extend upwardly from the corner area which forms the apex of the right angle of said right triangular-shaped jackets.

4. The wall partition according to claim 1, additionally including a plurality of freely-rotatable support members, each of which is supported on the upper end of one of said vertical supports in an incremental and axially adjustable manner relative to said vertical supports, and which support said lateral supports, and wherein said vertical supports and said sheaths are threadably secured together to permit axial adjustment of said vertical supports relative to said sheaths.

5. The wall partition according to claim 1, additionally including a plurality of auxiliary, horizontally-extending, lateral supports each of which extends between a pair of adjacent vertical supports and is disposed parallel and adjacent to said lateral support of said first mentioned plurality, said auxiliary lateral supports being rotatable about their longitudinal axes and being arrestable in a fixed position, said partition also including secondary filler material which is wound on each of said auxiliary lateral supports in an opposite direction to said filler material wound on said lateral supports.

6. The wall partition according to claim 1, wherein said filler material comprises a unitary web of material which extends across the total width of the wall partition, said filler material having a plurality of vertically-extending slots formed in the upper end thereof spaced apart a distance corresponding to the distance between said vertical supports, the upper portion of said web disposed between said slots being woundable on said lateral supports.

7. The wall partition according to claim 1, wherein said filler material is made from rubber.

* * * * *

UNITED STATES PATENT OFFICE

CERTIFICATE OF CORRECTION

Patent No. 4,143,698 Dated MARCH 13, 1979

Inventor(s) KURT SMOLKA

It is certified that error appears in the above-identified patent and that said Letters Patent are hereby corrected as shown below:

Column 2, line 32, change "aned" to --and--; Column 3, line 28, change "heat-sealing" to --head-sealing--; Column 3, line 36, after 'manner' insert --.--; Column 4, line 9, change "claim" to --claimed--; Column 4, line 41, change "spaced" to --space--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*